US011713564B2

(12) United States Patent
Shon et al.

(10) Patent No.: US 11,713,564 B2
(45) Date of Patent: Aug. 1, 2023

(54) FAUCET CONTROL DEVICE AND METHOD, AND FAUCET

(71) Applicant: THE SL CO., LTD., Seoul (KR)

(72) Inventors: Byoung Kyu Shon, Daejeon (KR); Seung Hwan Tak, Seoul (KR); In-Ho Song, Seoul (KR)

(73) Assignee: THE SL CO., LTD., Seoul (KR)

( * ) Notice: Subject to any disclaimer, the term of this patent is extended or adjusted under 35 U.S.C. 154(b) by 353 days.

(21) Appl. No.: 17/045,113

(22) PCT Filed: Apr. 4, 2019

(86) PCT No.: PCT/KR2019/004000
§ 371 (c)(1),
(2) Date: Oct. 2, 2020

(87) PCT Pub. No.: WO2019/194601
PCT Pub. Date: Oct. 10, 2019

(65) Prior Publication Data

US 2021/0148098 A1 May 20, 2021

(30) Foreign Application Priority Data

Apr. 4, 2018 (KR) ..... 10-2018-0039253

(51) Int. Cl.
*E03C 1/04* (2006.01)
*E03C 1/044* (2006.01)
*E03C 1/05* (2006.01)

(52) U.S. Cl.
CPC ..... *E03C 1/041* (2013.01); *E03C 1/044* (2013.01); *E03C 1/0412* (2013.01); *E03C 1/057* (2013.01); *E03C 1/055* (2013.01)

(58) Field of Classification Search
CPC ..... E03C 1/041; E03C 1/0412; E03C 1/044; E03C 1/057; E03C 1/055
See application file for complete search history.

(56) References Cited

U.S. PATENT DOCUMENTS 4,756,030 A * 7/1988 Juliver ..... E03C 1/055 4/677
6,446,875 B1 * 9/2002 Brooks ..... E03C 1/05 236/12.12

(Continued)

FOREIGN PATENT DOCUMENTS

GB 2488361 A 8/2012
JP H06-159698 A 6/1994

(Continued)

*Primary Examiner* — Patrick C Williams
(74) *Attorney, Agent, or Firm* — United One Law Group LLC; Kongsik Kim; Jhongwoo Peck

(57) ABSTRACT

Disclosed are faucet control device and method. A faucet control device capable of automatic temperature control comprises: a first pressure sensor and a second pressure sensor installed in a hot water pipe and a cold water pipe to measure the pressures of hot water and cold water, respectively; a first temperature sensor and a second temperature sensor installed in the hot water pipe and the cold water pipe to measure the temperatures of the hot water and the cold water, respectively; a heating member disposed between the hot water pipe and a faucet; a rotation sensor for measuring at least one of a horizontal rotation angle and a vertical rotation angle when an operation of a faucet knob terminates; a first electronic valve and a second electronic valve installed on discharge ports of the hot water and the cold water, respectively; and a controller for determining a stop position of the faucet knob by using at least one of the horizontal rotation angle and the vertical rotation angle and controlling whether to operate the heating member and the opening degrees of the first electronic valve and the second electronic valve according to the determined stop position of the faucet knob by using the pressures of the hot water and the cold water and the temperatures of the hot water and the cold water.

7 Claims, 6 Drawing Sheets

(56) References Cited

U.S. PATENT DOCUMENTS

| | | | | |
|---|---|---|---|---|
| 2014/0069516 | A1* | 3/2014 | Shapira | E03C 1/055 137/88 |
| 2016/0208946 | A1* | 7/2016 | Moghe | F16K 11/22 |

FOREIGN PATENT DOCUMENTS

| | | | |
|---|---|---|---|
| JP | H1046637 | A | 2/1998 |
| JP | 2002004365 | A | 1/2002 |
| JP | 2005105529 | A | 4/2005 |
| JP | 3780986 | B2 | 3/2006 |
| JP | 2013-124519 | A | 6/2013 |
| JP | 2014194317 | A | 10/2014 |
| JP | 2015190204 | A | 11/2015 |
| JP | 2017-536493 | A | 12/2017 |
| KR | 20060022059 | A | 3/2006 |
| KR | 20090109836 | A | 10/2009 |
| KR | 101742568 | B1 | 5/2017 |

* cited by examiner

FAUCET CONTROL DEVICE AND METHOD, AND FAUCET

CROSS-REFERENCES TO RELATED APPLICATIONS

This application is a National Stage Entry of International Application PCT/KR2019/004000 filed Apr. 4, 2019, which claims priority from Korean Application KR 10-2018-0039253 filed on Apr. 4, 2018. The aforementioned patent applications are incorporated herein by reference in their entirety.

TECHNICAL FIELD

The present invention relates to faucet control device and method capable of automatic temperature control, and a faucet.

BACKGROUND ART

A faucet installed in a sink, a basin, or the like is configured by a main body formed to supply cold and hot water from cold and hot water pipes, respectively, and a lever installed on the main body to control water and select the cold or hot water. When a user rotates or lifts the lever while holding the lever, the water may be blocked or supplied, and the temperature of the water to be supplied may be controlled. In addition to controlling the quantity of water while opening and closing the lever, the temperature of the water is controlled by adjusting a rotation angle of the lever when hot water and cold water come out from one faucet bracket.

The temperature of hot water to be supplied through the faucet is affected by the condition of a boiler in the case of an individual supply system. For example, while the hot water is secured by sufficiently operating the boiler in advance, the faucet is operated and the hot water is supplied at the same time, but at the time when the boiler is operated in a short time, cold water is initially supplied, and then the quantity of hot water gradually increases to reach a predetermined temperature. On the other hand, in the case of a central supply system, a distance from a hot water supply source to a hot water consumption place, an external temperature, water pressure, and whether or not the adjacent furniture uses hot water are affected.

In addition, when the temperature inside the hot water faucet is not uniform, the hot water is suddenly supplied through the faucet, or the temperature of the water is frequently changed during hot water supply. Such a sudden change in the hot water temperature may cause burns on the skin due to the high-temperature hot water, and the temperature of the water to be supplied may instantly cool, thereby causing inconvenience to the user. Furthermore, even when the supply pressure of the hot water is changed, there is a problem in that the temperature of the water is changed.

SUMMARY

An object of the present invention is to provide faucet control device and method capable of automatic temperature control.

Another object of the present invention is to provide faucet control device and method capable of automatically controlling a discharged temperature to be constantly maintained even if the supply pressure of hot water or cold water is changed.

Yet another object of the present invention is to provide a faucet capable of automatically controlling a discharged temperature to be constantly maintained even if the supply pressure of hot water or cold water is changed.

According to an aspect of the present invention, there is provided a faucet control device capable of automatic temperature control.

According to an embodiment of the present invention, there is provided a faucet control device comprising: a first pressure sensor and a second pressure sensor installed in a hot water pipe and a cold water pipe to measure the pressures of hot water and cold water, respectively; a first temperature sensor and a second temperature sensor installed in the hot water pipe and the cold water pipe to measure the temperatures of the hot water and the cold water, respectively; a first electronic valve and a second electronic valve installed on discharge ports of the hot water and the cold water, respectively; a heating member disposed between the hot water pipe and the first electronic valve; a rotation sensor for measuring at least one of a horizontal rotation angle and a vertical rotation angle when an operation of a faucet knob terminates; and a controller for determining a stop position of the faucet knob by using at least one of the horizontal rotation angle and the vertical rotation angle, and controlling whether to operate the heating member and the opening degrees of the first electronic valve and the second electronic valve according to the determined stop position of the faucet knob by using the pressures of the hot water and the cold water and the temperatures of the hot water and the cold water.

The controller may set the middle of a maximum horizontal rotation angle of the faucet knob as a horizontal rotation reference point, set the lowest position of the faucet knob as a vertical rotation reference point, and calculate the horizontal rotation angle and the vertical rotation angle of the faucet knob by using the horizontal rotation reference point and the vertical rotation reference point.

The controller may calculate a target quantity and a target temperature of the discharged water corresponding to the stop position of the faucet knob and control the opening degrees of the first electronic valve and the second electronic valve based on the quantities of the hot water and the cold water and the temperatures of the hot water and the cold water calculated by using the pressures of the hot water and the cold water, so that the quantity and the temperature of the discharged water become the target quantity and the target temperature.

The controller may calculate an increased quantity of the cold water by using the target quantity of the discharged water corresponding to the stop position of the faucet knob, the temperature of the hot water, the temperature of the cold water, the quantity of the hot water, and the quantity of the cold water when the temperature of the hot water measured by the first temperature sensor is higher than the target temperature of the discharged water corresponding to the stop position of the faucet knob. In addition, the controller may set a decreased quantity of the hot water by the increased quantity of the cold water, but control the opening degrees of the first electronic valve and the second electronic valve by reflecting the increased quantity of the cold water and the decreased quantity of the hot water.

The faucet control device further comprises a third temperature sensor positioned inside the heating member and measuring a temperature. When the temperature of the hot water measured by the first temperature sensor is less than the target temperature of the discharged water, the controller may operate the heating member until the temperature of the hot water measured by the third temperature sensor reaches the target temperature of the discharged water corresponding to the stop position of the faucet knob and control the second electronic valve to be closed. When the quantity of the hot water calculated by using the pressure of the hot water is less than the target quantity of the discharged water corresponding to the stop position of the faucet knob, the controller may control the first electronic valve to be fully opened. In addition, when the quantity of the hot water calculated by using the pressure of the hot water is greater than the target quantity of the discharged water corresponding to the stop position of the faucet knob, the controller may control opening degree of the first electronic valve so that the quantity of the discharged water is the same as the target quantity of the discharged water corresponding to the stop position of the faucet knob. In addition, when the temperature of the hot water measured by the first temperature sensor reaches the target temperature of the discharged water corresponding to the stop position of the faucet knob, the controller may stop the operation of the heating member and control the opening degrees of the first electronic valve and the second electronic valve based on the quantities of the hot water and the cold water calculated by using the pressures of the hot water and the cold water and the temperatures of the hot water and the cold water measured by the first temperature sensor and the second temperature sensor, so that the quantity and the temperature of the discharged water become the target quantity and the target temperature.

The controller may monitor the quantity of the hot water and the quantity of the cold water by using the pressure of the hot water and the pressure of the cold water, and then, when both the quantity of the hot water and the quantity of the cold water are increased, the controller may control the opening degrees of the first electronic valve and the second electronic valve so as to decrease the quantity of the hot water and the quantity of the cold water by the quantity of the hot water and the quantity of the cold water increased to maintain the quantity of the discharged water. In addition, when the quantity of the hot water is decreased, the controller may control the opening degree of the second electronic valve so that the quantity of the cold water is decreased by the decreased quantity of the hot water so as to the maintain the temperature of the discharged temperature, and when the quantity of the cold water is decreased, the controller may control the opening degree of the second electronic valve so that the quantity of the hot water is decreased by the decreased quantity of the cold water so as to maintain the temperature of the discharged water.

The controller may monitor the quantity of the hot water and the quantity of the cold water by using the pressure of the hot water and the pressure of the cold water, and then, when the quantity of the hot water is decreased, the controller may control the opening degree of the second electronic valve so that the quantity of the cold water is increased by the decreased quantity of the hot water so as to maintain the quantity of the discharged water and control the heating member to be operated in response to the temperature of the discharged water so as to maintain the temperature of the discharged water.

When the pressure of the hot or cold water is changed, the controller may control the opening degrees of the first electronic valve and the second electronic valve by calculating a temperature change amount of the discharged water according to a water pressure change amount.

The heating member is configured by a plurality of heaters, which may be sequentially operated from a heater installed adjacent to an inflow point of the hot water pipe.

According to another embodiment of the present invention, there is provided a faucet control device which controls first and second electronic valves installed on discharge ports of a hot water pipe and a cold water pipe, respectively, and a heating member installed between the hot water pipe and the first electronic valve, the faucet control device comprising a processor; and a memory connected to the processor, wherein the memory stores program instructions executable by the processor to determine a stop position of a faucet knob by using a horizontal rotation angle and a vertical rotation angle of the faucet knob measured by a rotation sensor and determine whether to operate the heating member and the opening degrees of the first and second electronic valves by using the pressure and temperature of the hot water in the hot water pipe and the pressure and temperature of the cold water in the cold water pipe.

According to another embodiment of the present invention, there is provided a faucet control device comprising: a first pressure sensor and a second pressure sensor installed in a hot water pipe and a cold water pipe to measure the pressures of hot water and cold water, respectively; a first temperature sensor and a second temperature sensor installed in the hot water pipe and the cold water pipe to measure the temperatures of the hot water and the cold water, respectively; a first electronic valve and a second electronic valve installed on discharge ports of the hot water and the cold water, respectively; a heating member disposed between the hot water pipe and the first electronic valve; a third temperature sensor disposed on a hot water discharge port of the heating member or inside the heating member and measuring the temperature of the hot water discharged from the heating member; a rotation sensor for measuring at least one of a horizontal rotation angle and a vertical rotation angle when an operation of a faucet knob terminates; and a controller for determining a stop position of the faucet knob by using at least one of the horizontal rotation angle and the vertical rotation angle and controlling whether to operate the heating member and the opening degrees of the first electronic valve and the second electronic valve according to the determined stop position of the faucet knob by using the pressures of the hot water and the cold water and the temperatures of the hot water and the cold water. The controller may calculate a target quantity and a target temperature of the discharged water corresponding to the stop position of the faucet knob and monitor the quantity of the hot water and the quantity of the cold water by using the pressure of the hot water and the pressure of the cold water to adaptively control the opening degrees of the first electronic valve and the second electronic valve. Here, (a) when the temperature of the hot water measured by the first temperature sensor is less than the target temperature of the discharged water, (a1) the controller may operate the heating member until the temperature of the hot water measured by the third temperature sensor reaches the target temperature of the discharged water corresponding to the stop position of the faucet knob and control the second electronic valve to be closed, and when the quantity of the hot water calculated by using the pressure of the hot water is less than the target quantity of the discharged water corresponding to the stop position of the faucet knob, the controller may control the first electronic valve to be fully opened, and when the quantity of the hot water calculated by using the pressure of the hot water is greater than the target quantity of the discharged water corresponding to the stop position of the faucet knob, the controller may control the opening degree of the first electronic valve so that the quantity of the discharged water is the same as the target quantity of the discharged water corresponding to the stop position of the faucet knob. In addition, (a2) when the temperature of the hot water measured by the first temperature sensor reaches the target temperature of the discharged water corresponding to the stop position of the faucet knob, the controller may stop the operation of the heating member and control the opening degrees of the first electronic valve and the second electronic valve based on the quantities of the hot water and the cold water calculated by using the pressures of the hot water and the cold water and the temperatures of the hot water and the cold water measured by the first temperature sensor and the second temperature sensor, so that the quantity and the temperature of the discharged water become the target quantity and the target temperature. Further, (b) when the temperature of the hot water measured by the first temperature sensor is greater than or equal to the target temperature of the discharged water, (b1) the controller may control the opening degrees of the first electronic valve and the second electronic valve based on the quantities of the hot water and the cold water calculated by using the pressures of the hot water and the cold water and the temperatures of the hot water and the cold water, so that the quantity and the temperature of the discharged water become the target quantity and the target temperature. In addition, (b2) when at least one of the pressure of the hot water measured by the first pressure sensor and the pressure of the cold water measured by the second pressure sensor is changed while the quantity and the temperature of the discharged water become the target quantity and the target temperature, (b21) when both the pressure of the hot water and the pressure of the cold water are increased, the controller may control the opening degrees of the first electronic valve and the second electronic valve so that the quantity and the temperature of the discharged water become the target quantity and the target temperature of the discharged water by decreasing the quantity of the hot water and the quantity of the cold water. In addition, (b22) when the pressure of the hot water is decreased, the controller may control the opening degree of the second electronic valve so that the temperature of the discharged water becomes the target temperature of the discharged water by decreasing the quantity of the cold water by the decreased quantity of the hot water, or control the opening degree of the second electronic valve so as to increase the quantity of the cold water by the decreased quantity of the hot water and operate the heating member to control the temperature of the hot water to be increased. In addition, (b23) when the quantity of the cold water is decreased, the controller may control the opening degree of the first electronic valve so as to decrease the quantity of the hot water by the decreased quantity of the cold water.

According to another aspect of the present invention, there is provided a faucet control method capable of automatic temperature control.

According to an embodiment of the present invention, there is provided a faucet control method comprising: (a) calculating the quantities of hot water and cold water by using the pressures of the hot water and the cold water measured from pressure sensors installed in a hot water pipe and a cold water pipe, respectively; (b) determining a current stop position of a faucet knob by using a horizontal rotation angle and a vertical rotation angle of the faucet knob measured by a rotation sensor; (c) calculating a target quantity and a target temperature of discharged water according to the current stop position of the faucet knob; and (d) controlling the opening degrees of a first electronic valve and a second electronic valve installed on discharge ports of the hot water pipe and the cold water pipe by using the quantities of the hot water and the cold water and the temperatures of the hot water and the cold water measured by the temperature sensors installed in the hot water pipe and the cold water pipe so that the temperature and the quantity of the discharged water become the target quantity and the target temperature of the discharged water.

According to another aspect of the present invention, there is provided a faucet comprising: a hot water pipe; a cold water pipe; a faucet knob; a first temperature sensor and a second temperature sensor installed at a hot water inlet of the hot water pipe and a cold water inlet of the cold water pipe, respectively; a first pressure sensor and a second pressure sensor installed in the hot water pipe and the cold water pipe, respectively; a first electronic valve and a second electronic valve installed on a hot water discharge port of the hot water pipe and a cold water discharge port of the cold water pipe, respectively; a heating member installed between the hot water inlet of the hot water pipe and the first electronic valve; a third temperature sensor installed on the hot water outlet of the heating member or inside the heating member; a rotation sensor for measuring at least one of a horizontal rotation angle and a vertical rotation angle when an operation of the faucet knob terminates; and a controller for determining a stop position of the faucet knob by using at least one of the horizontal rotation angle and the vertical rotation angle, and controlling whether to operate the heating member, the opening degree of the first electronic valve, and the opening degree of the second electronic valve based on the values measured by the first temperature sensor, the second temperature sensor, the third temperature sensor, the first pressure sensor, and the second pressure sensor. The controller may calculate a target quantity and a target temperature of the discharged water corresponding to the stop position of the faucet knob and monitor the pressure of the hot water and the pressure of the cold water and the temperature of the hot water and the temperature of the cold water to adaptively control whether to operate the heater, the opening degree of the first electronic valve, and the opening degree of the second electronic valve. Here, (a) when the temperature of the hot water measured by the first temperature sensor is less than the target temperature of the discharged water, (a1) the controller may operate the heating member until the temperature of the hot water measured by the third temperature sensor reaches the target temperature of the discharged water corresponding to the stop position of the faucet knob and control the second electronic valve to be closed, and when the quantity of the hot water calculated by using the pressure of the hot water is less than the target quantity of the discharged water corresponding to the stop position of the faucet knob, the controller may control the first electronic valve to be fully opened, and when the quantity of the hot water calculated by using the pressure of the hot water is greater than the target quantity of the discharged water corresponding to the stop position of the faucet knob, the controller may control the opening degree of the first electronic valve so that the quantity of the discharged water is the same as the target quantity of the discharged water corresponding to the stop position of the faucet knob. In addition, (a2) when the temperature of the hot water measured by the first temperature sensor reaches the target temperature of the discharged water corresponding to the stop position of the faucet knob, the controller may stop the operation of the heating member and control the opening degrees of the first electronic valve and the second electronic valve based on the quantities of the hot water and the cold water calculated by using the pressures of the hot water and the cold water and the temperatures of the hot water and the cold water measured by the first temperature sensor and the second temperature sensor, so that the quantity and the temperature of the discharged water become the target quantity and the target temperature. Further, (b) when the temperature of the hot water measured by the first temperature sensor is greater than or equal to the target temperature of the discharged water, (b1) the controller may control the opening degrees of the first electronic valve and the second electronic valve based on the quantities of the hot water and the cold water calculated by using the pressures of the hot water and the cold water and the temperatures of the hot water and the cold water, so that the quantity and the temperature of the discharged water become the target quantity and the target temperature. In addition, (b2) when at least one of the pressure of the hot water measured by the first pressure sensor and the pressure of the cold water measured by the second pressure sensor is changed while the quantity and the temperature of the discharged water become the target quantity and the target temperature, (b21) when both the pressure of the hot water and the pressure of the cold water are increased, the controller may control the opening degrees of the first electronic valve and the second electronic valve so that the quantity and the temperature of the discharged water become the target quantity and the target temperature of the discharged water by decreasing the quantity of the hot water and the quantity of the cold water. In addition, (b22) when the pressure of the hot water is decreased, the controller may control the opening degree of the second electronic valve so that the temperature of the discharged water becomes the target temperature of the discharged water by decreasing the quantity of the cold water by the decreased quantity of the hot water, or control the opening degree of the second electronic valve so as to increase the quantity of the cold water by the decreased quantity of the hot water and operate the heating member to control the temperature of the hot water to be increased. In addition, (b23) when the quantity of the cold water is decreased, the controller may control the opening degree of the first electronic valve so as to decrease the quantity of the hot water by the decreased quantity of the cold water.

By providing faucet control device and method capable of automatic temperature control, and a faucet according to an embodiment of the present invention, it is possible to automatically control the temperature to be discharged to be constantly maintained even if the supply pressure of the hot or cold water is changed.

DETAILED DESCRIPTION

A singular form used in the present specification may include a plural form unless otherwise clearly meant in the context. In this specification, terms such as "comprising" or "including" should not be interpreted as necessarily including all various components or various steps disclosed in the specification, and it should be interpreted that some component or some steps among them may not be included or additional components or steps may be further included. In addition, terms including "unit', "module", or the like disclosed in the specification mean a unit that processes at least one function or operation, which may be implemented by hardware or software or a combination of hardware and software.

Hereinafter, embodiments of the present invention will be described in detail with reference to the accompanying drawings.

Figure 1:
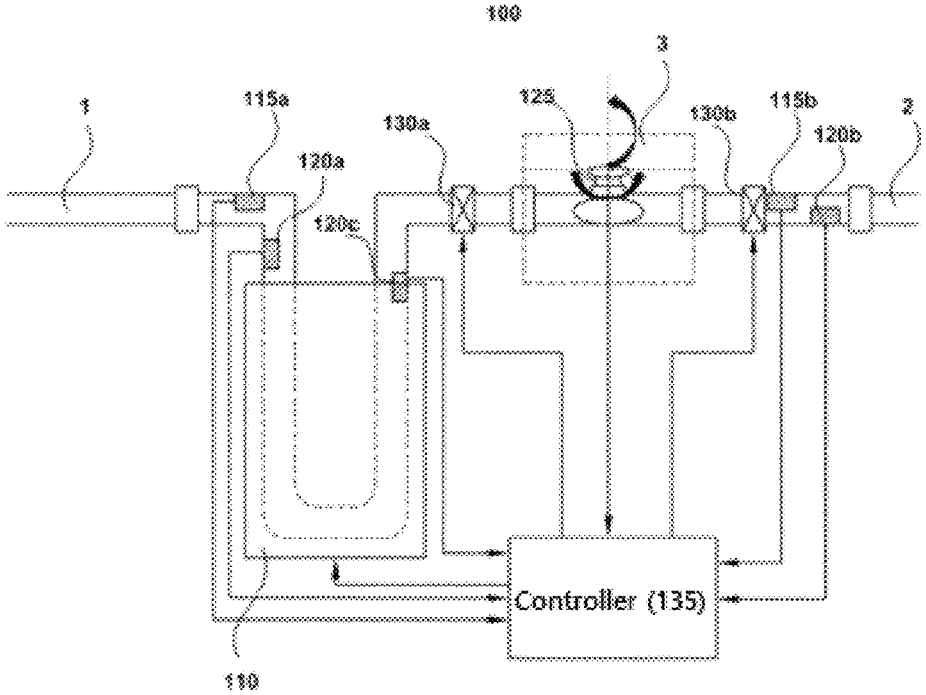
FIG. 1 is a diagram illustrating a configuration of a faucet control device according to an embodiment of the present invention.

FIG. 1 is a diagram illustrating a configuration of a faucet control device according to an embodiment of the present invention.

Referring to FIG. 1, a faucet control device 100 according to an embodiment of the present invention includes a heating member 110, a plurality of pressure sensors 115*a* and 115*b*, a plurality of temperature sensors 120*a* to 120*c*, a rotation sensor 125, a plurality of electronic valves 130*a* and 130*b*, and a controller 135.

The heating member 110 is located at a part of a water supply pipe, and may be turned on or off according to the control of the controller 135. For example, as illustrated in FIG. 1, the heating member 110 may be installed between a hot water pipe 1 and a faucet 3.

In FIG. 1, it is illustrated that there is one heating member 110, but a plurality of heating members 110 may be installed. When there is a plurality of heating members 110, the controller 135 may control the heating members 110 to sequentially increase the temperature along the water supply pipe. In addition, it is natural that the plurality of heating members 110 may be configured in a separate form in one device, or may be provided in the form of separate heating members. When the plurality of heating members 110 are provided, it is preferable to sequentially increase the temperature of the hot water by sequentially driving a heater closer to the inflow point of the hot water. Through this, there is an advantage of enabling precise temperature control for the hot water. For example, assuming that the temperature of the hot water required by the vertical and horizontal rotation amounts of the faucet knob is 38° C., if the temperature of the hot water first flowing into the heater is 25° C., the first heater may be controlled to raise the temperature of the hot water to 35° C. and the second heater may be controlled to raise the temperature of the hot water to 38° C.

The pressure sensors 115*a* and 115*b* measure the pressures of the water supply pipes (the hot water pipe 1 and the cold water pipe 2).

As illustrated in FIG. 1, the pressure sensors 115*a* and 115*b* are provided in the hot water pipe 1 and the cold water pipe 2 to measure the pressures of the hot water pipe 1 and the cold water pipe 2, respectively. Hereinafter, the pressure sensor installed in the hot water pipe 1 will be collectively referred to as the first pressure sensor 115*a*, and the pressure sensor installed in the cold water pipe 2 will be collectively referred to as the second pressure sensor 115*b*.

The first pressure sensor 115*a* and the second pressure sensor 115*b* may measure the pressures of the hot water pipe 1 and the cold water pipe 2, and output the measured values (hereinafter referred to as measurement values) to the controller 135. In addition, the first pressure sensor 115*a* may be installed at a hot water inflow point through which the hot water flows into the heating member 110.

The temperature sensors 120*a* to 120*c* measure the temperatures of the water supply pipes (the hot water pipe 1 and the cold water pipe 2).

The first temperature sensor 120*a* may be installed at a hot water inlet through which the hot water flows into the heating member 110 to measure a temperature (hereinafter, referred to as a hot water temperature) of the hot water supplied through the hot water pipe 1. In addition, the second temperature sensor 120*b* is installed in the cold water pipe 2 and may measure a temperature (hereinafter, referred to as a cold water temperature) of the cold water supplied through the cold water pipe 2.

The hot water temperature and the cold water temperature measured by the first temperature sensor 120*a* and the second temperature sensor 120*b* may be output to the controller 135.

In addition, a third temperature sensor 120*c* for measuring the temperature of the hot water that has passed through the heating member 110 may also be provided in an outlet through which the hot water flows out of the heating member 110 or inside the heating member 110. The third temperature sensor 120*c* may also output the measured hot water temperature to the controller 135.

The rotation sensor 125 is installed in the faucet, and is configured to measure the horizontal rotation angle and the vertical rotation angle of the faucet knob.

The electronic valves 130*a* and 130*b* are configured to control the quantity of the hot or cold water supplied to the faucet. The electronic valves 130*a* and 130*b* may control the quantities of the hot and cold water supplied to the faucet according to the control of the controller 135. The electronic valves 130*a* and 130*b* may be opened and closed according to the control of the controller 135.

The controller 135 may control the internal components of the faucet control device 100 illustrated in FIG. 1 (e.g., the heating member 110, the plurality of pressure sensors 115*a*, 115*b*, the plurality of temperature sensors 120*a* to 120*c*, and the plurality of electronic valves 130*a* and 130*b*).

In addition, the controller 135 may control on/off of the heating member 110 and control the opening and closing and the opening degrees of the electronic valves (the first electronic valve 130*a* and the second electronic valve 130*b*) based on at least one of the hot water temperature, the cold water temperature, the water pressure, and the vertical and horizontal rotation amounts of the faucet operation knob acquired by each sensor.

To this end, the controller 135 may include a memory and a processor, although not illustrated in FIG. 1. Instructions for performing the respective methods to be described with reference to FIGS. 2 to 6 may be stored in the memory. In addition, the processor may execute instructions stored in the memory. Detailed operations thereof will be described below with reference to FIGS. 2 to 6.

Figure 2:
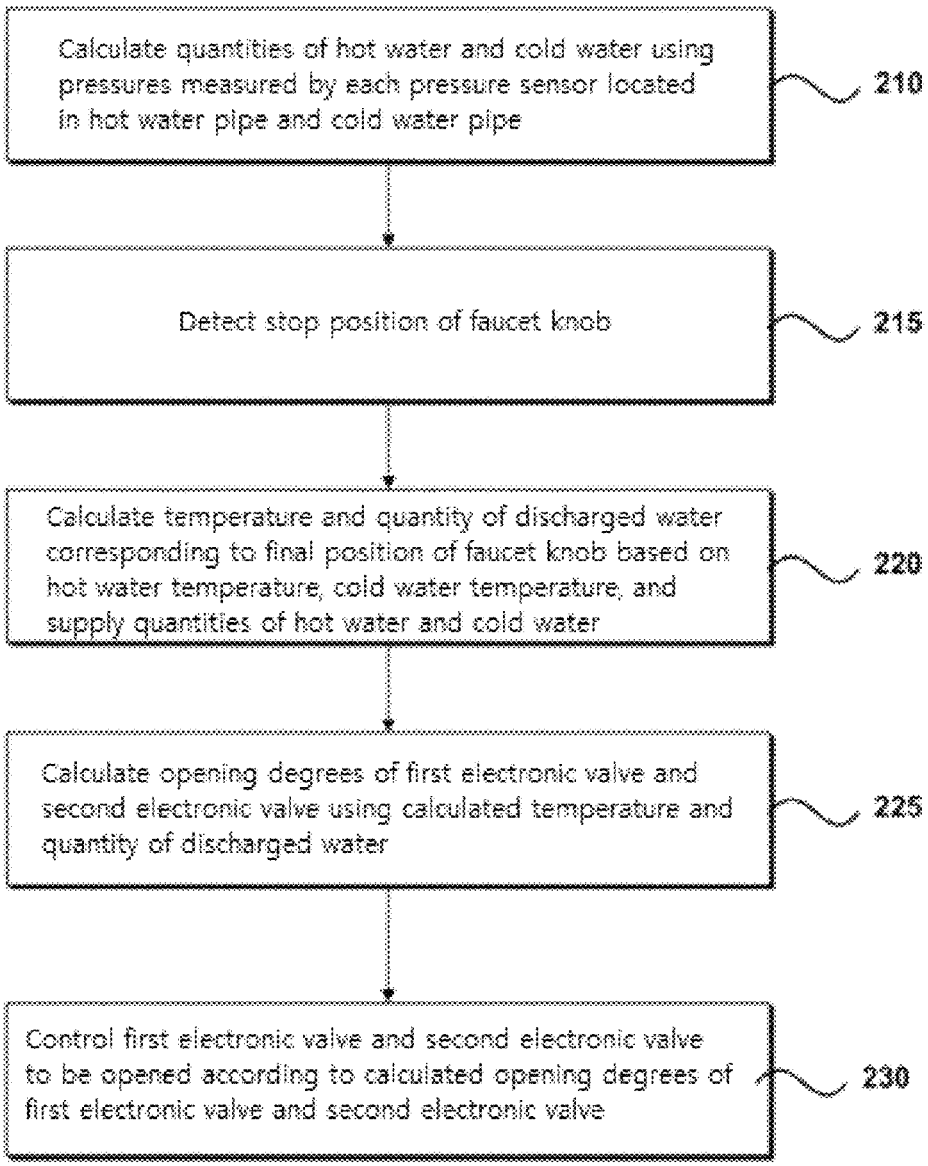
FIG. 2 is a flowchart illustrating a faucet control method according to an embodiment of the present invention.
Figure 3:
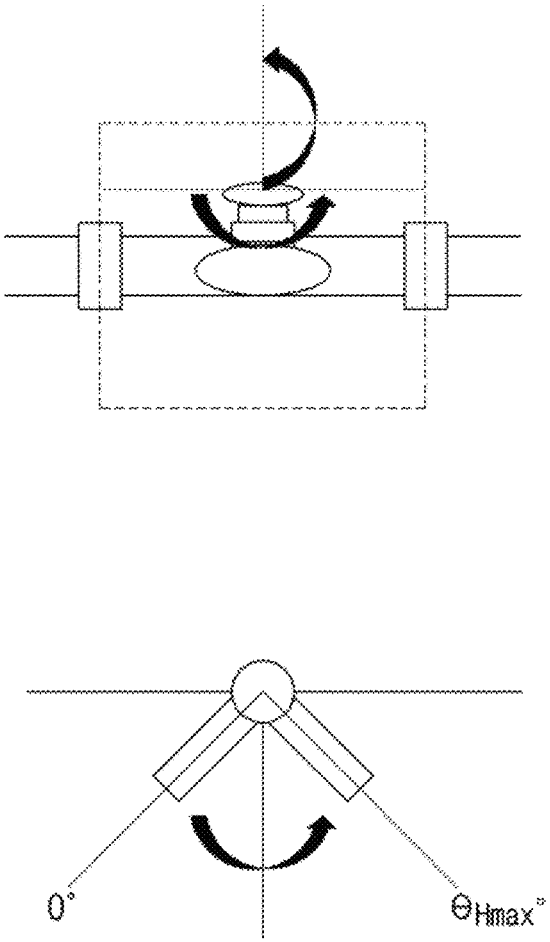
FIGS. 3 and 4 are diagrams for describing a horizontal rotation angle and a vertical rotation angle of a faucet knob according to an embodiment of the present invention.
Figure 4:
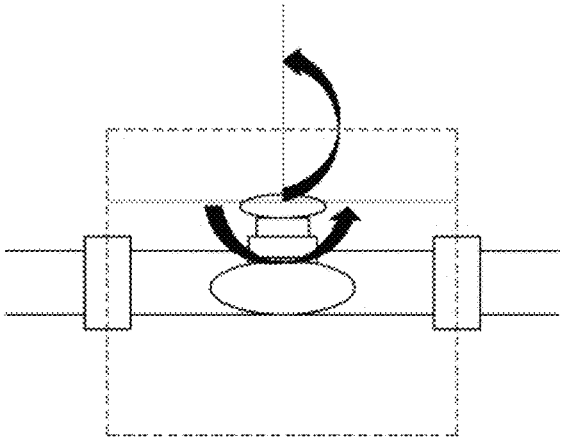
Figure 4:
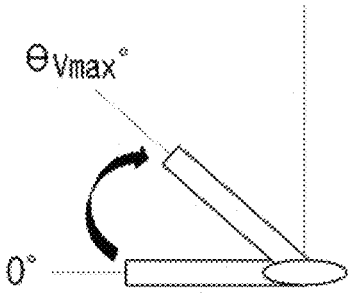
Figure 5:
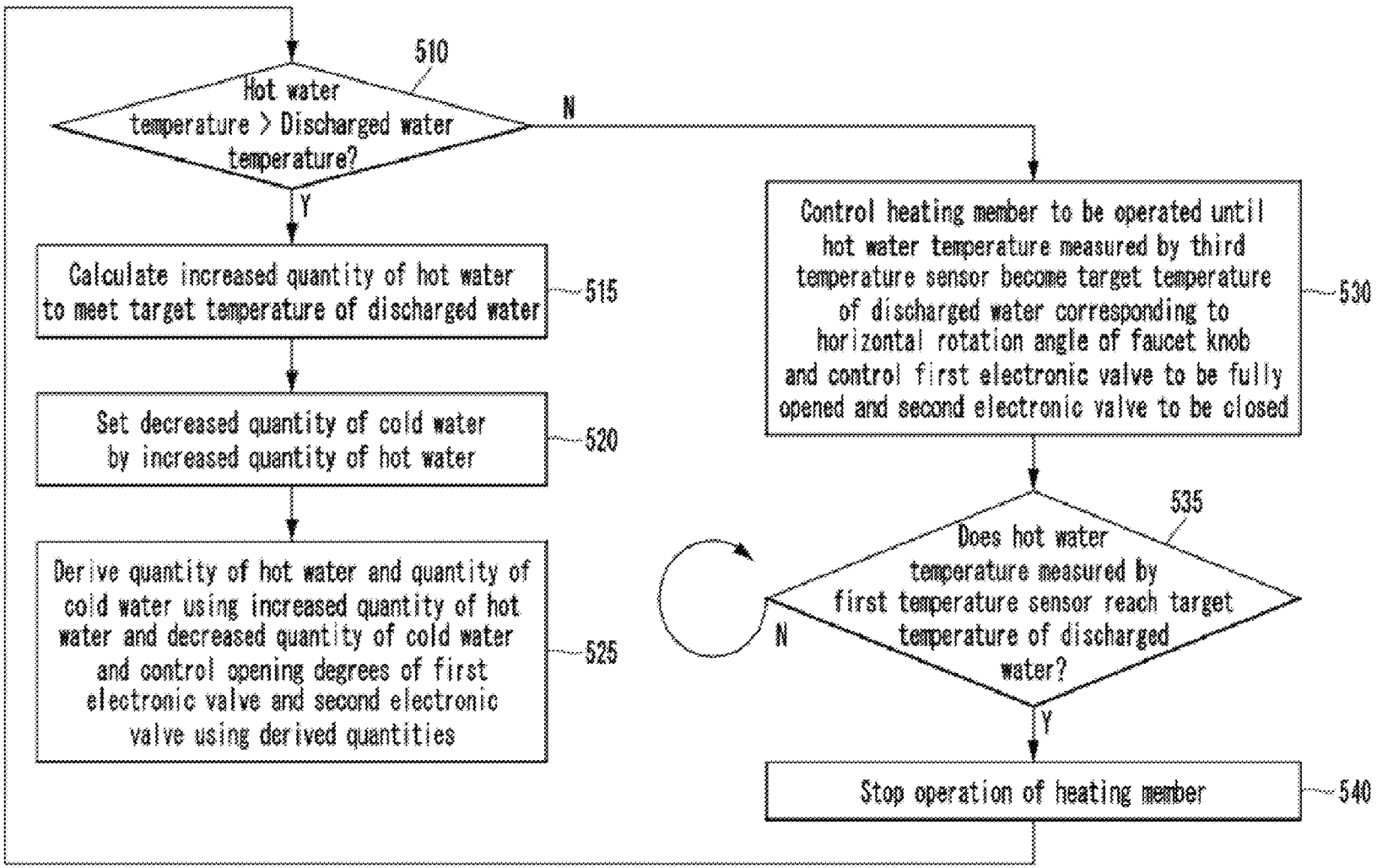
FIG. 5 is a flowchart illustrating a method for controlling a valve by a faucet control device according to an embodiment of the present invention.

FIG. 2 is a flowchart illustrating a faucet control method according to an embodiment of the present invention, and FIGS. 3 and 4 are diagrams for describing a horizontal rotation angle and a vertical rotation angle of a faucet knob according to an embodiment of the present invention.

In step 210, the faucet control device 100 calculates the quantities of the hot water and the cold water by using the pressures measured by the pressure sensors 115*a* and 115*b* located in the hot water pipe 1 and the cold water pipe 2.

For example, the quantity according to the water pressure may be derived using Equations 1 and 2.

$$P = \frac{rV^2}{2g} \quad \text{[Equation 1]}$$

Wherein, P represents the water pressure (kg/m$^2$), r represents the density of water (varied depending on the temperature, but set to 1000 kg/m$^3$ in this specification), V represents the flow velocity (m/s), and g represents the acceleration of gravity (9.8/m$^2$).

$$Q=AV \quad \text{[Equation 2]}$$

Wherein, Q represents the water quantity and A represents the cross-sectional area of the pipe.

Equation 3 may be derived by Equations 1 and 2.

$$Q=K\sqrt{P} \quad \text{[Equation 3]}$$

Wherein, assuming that K=A√(2 g/r), and the acceleration of gravity, the density of water, and the cross-sectional area of the pipe are constant, K becomes a constant, and thus, it can be seen that the water pressure is proportional to the square of the water quantity.

For example, when the inner diameter of the pipe is 15 mm, the density of water is 1000 kg/m$^3$, and the acceleration of gravity is 9.8/m$^2$, K=0.000024738. Therefore, when a normal discharged water pressure is 3.0 kg/cm$^2$, the water quantity is 0.004283 m$^3$/s.

Therefore, when the water pressures measured by the first pressure sensor and the second pressure sensor are A kg/m$^2$ and B kg/m$^2$, respectively, and when A is less than B, a quantity ratio of the hot water and the cold water is A:B/A. From this, the quantities and the quantity ratio of the hot water and the cold water may be calculated.

In summary, the faucet control device 100 may calculate the quantities and the quantity ratio of the hot water and the cold water by using the hot water pressure and the cold water pressure measured by the first pressure sensor 115*a* and the second pressure sensor 115*b*, respectively.

In step 215, the faucet control device 100 detects a stop position of the faucet knob.

For example, the faucet control device 100 may detect the stop position of the faucet knob based on a previous stop position (horizontal and vertical rotation amounts at a previous operation ending point) and a current movement amount (horizontal and vertical rotation amounts) of the faucet knob.

Referring to FIG. 3, in the horizontal rotation amount of the faucet knob, it is assumed that an angle when the faucet knob is rotated to the leftmost side is set to 0° and an angle when the faucet knob is rotated to the rightmost side is set to $\theta_{Hmax}$°. In this case, when the faucet knob is located in the center, the angle of the faucet knob is equal to 0.5 $\theta_{Hmax}$°. That is, when the horizontal rotation angle of the faucet knob is 0° to 90°, the angle when the faucet knob is located in the center is 45°.

In addition, the vertical rotation amount of the faucet knob will be described with reference to FIG. 4. In the vertical rotation amount of the faucet knob, an angle when the faucet knob is located at the lowermost end is set to 0°, and an angle when the faucet knob is located at the uppermost end (top) is set to $\theta_{Vmax}$°. For example, the vertical rotation amount of the faucet knob may be set in the range of 0° to 45°.

When the stop position is calculated based on the previous stop position and the current movement amount of the faucet knob, there is a problem that an error is gradually increased over time. Accordingly, the faucet control device 100 sets an intermediate angle (0.5 $\theta_{Hmax}$°) as a horizontal reference angle in the horizontal rotation angle of the faucet knob, sets 0° in which the faucet knob is located at the lowest end as a vertical reference angle in the vertical rotation angle, and then initiates the movement amount of the faucet knob if the faucet knob is located at the horizontal reference angle and the vertical reference angle. In addition, an error may be minimized by calculating the current movement amount of the faucet knob by measuring the vertical and horizontal rotation amounts of the faucet knob based on the initialized movement amount of the faucet knob.

In addition, the faucet control device 100 may determine a stop position detected at a time point when a predetermined time (e.g., 1 second) elapses from the time when the faucet knob is stopped as a final position.

In step 220, the faucet control device 100 calculates the temperature and the quantity of the discharged water corresponding to the final position of the faucet knob based on the hot water temperature, the cold water temperature, and the supply quantities of the hot water and the cold water.

For example, the temperature of the discharged water may be calculated using Equation 4.

$$T = \frac{T_H Q_{Hmax}(\theta_{Hmax} - \theta_H) + T_L Q_{Lmax}\theta_H}{Q_{Hmax}(\theta_{Hmax} - \theta_H) + Q_{Lmax}\theta_H} \quad \text{[Equation 4]}$$

Wherein, T represents a temperature of the discharged water, $T_H$ represents a hot water temperature, $T_L$ represents a cold water temperature, $Q_{Hamx}$ represents a maximum supply quantity of the hot water, $Q_{Lmax}$ represents a maximum supply quantity of the cold water, $\theta_H$ represents a horizontal rotation angle, and $\theta_{Hmax}$ represents a maximum horizontal rotation angle of the faucet knob.

The quantities of the hot water and the cold water may be calculated using Equations 5 and 6.

$$Q_H = Q_{Hmax}\left(1 - \frac{\theta_H}{\theta_{Hmax}}\right)\frac{\theta_V}{\theta_{Vmax}} \quad \text{[Equation 5]}$$

Wherein, $Q_H$ represents a quantity of the hot water, $\theta_V$ represents a vertical rotation angle of the faucet knob, and $\theta_{Vmax}$ represents a maximum vertical rotation angle of the faucet knob.

$$Q_L = Q_{Lmax}\frac{\theta_H\theta_V}{\theta_{Hmax}\theta_{Vmax}} \quad \text{[Equation 6]}$$

Wherein, $Q_L$ represents a quantity of the cold water.

The quantity of the hot water and the quantity of the cold water are calculated using Equations 5 and 6, respectively, and then the calculated quantities are summed to finally derive the quantity of the discharged water to be discharged from the faucet knob.

In step 225, the faucet control device 100 calculates the opening degrees of the first electronic valve and the second electronic valve by using the calculated temperature and quantity of the discharged water.

For example, the opening degrees of the first electronic valve and the second electronic valve may be calculated using Equations 7 and 8.

$$O_{\theta H} = \frac{Q_H}{Q_{Hmax}} \quad \text{[Equation 7]}$$

Wherein, $O_{\theta L}$ represents an opening ratio of the first electronic valve according to the horizontal rotation amount of the faucet knob relative to the maximum supply quantity of the hot water when the temperature of the discharged water to be discharged through the faucet knob is a target supply temperature.

$$O_{\theta L} = \frac{Q_L}{Q_{Lmax}} \quad \text{[Equation 8]}$$

Wherein, $O_{\theta L}$ represents an opening ratio of the second electronic valve according to the horizontal rotation amount of the faucet knob relative to the maximum supply quantity of the cold water when the temperature of the discharged water to be discharged through the faucet knob is a target supply temperature. $O_{\theta H}$ and $O_{\theta L}$ may be set to 1 when the valve is fully opened.

For example, when the horizontal rotation angle and the vertical rotation angle of the faucet knob are 30° and 20°, respectively, the maximum horizontal rotation angle and the maximum vertical rotation angle of the faucet knob are 90° and 45°, respectively, the maximum supply quantities of the hot water and the cold water are 0.0002 $m^3$/s and 0.0003 $m^3$/s, respectively, and the temperatures of the hot water and the cold water are 40° C. and 20° C., respectively, the quantity of the hot water may be derived as 0.000059 $m^3$/s and the quantity of the cold water may be derived as 0.000044 $m^3$/s. In this case, the temperature of the discharged water is 31.46° C., and the quantity of the discharged water is calculated as 0.000103 $m^3$/s. Accordingly, the opening degrees of the first electronic valve 130*a* and the second electronic valve 130*b* may be calculated as 0.295 (29.5%) and 0.147 (14.7%), respectively.

In addition, in the same condition as the aforementioned example, when the maximum supply temperature of the hot water is 45° C. and the maximum supply temperature of the cold water is 20° C., the temperature of the discharged water discharged through the faucet knob is calculated as 34.32° C., and may be set as a target temperature of the discharged water according to the rotation amount of the faucet knob in a normal state.

For example, when the horizontal rotation angle and the vertical rotation angle of the faucet knob are 30° and 20°, respectively, the maximum horizontal rotation angle and the maximum vertical rotation angle of the faucet knob are 90° and 45°, respectively, the maximum supply quantities of the hot water and the cold water are 0.0002 $m^3$/s and 0.0003 $m^3$/s, respectively, and the temperatures of the hot water and the cold water are 40° C. and 20° C., respectively, an increased quantity ΔQ in hot water required to meet the temperature of the discharged water to the target temperature of 34.32° C. may be derived as 0.00001475 $m^3$/s. A decreased quantity in cold water is equal to the increased quantity in hot water to be 0.00001475 $m^3$/s. Therefore, the quantities of the hot water and the cold water may be calculated as 0.00007375 $m^3$/s and 0.00002925 $m^3$/s, respectively. Accordingly, the opening degrees $O_H$ and $O_L$ of the first electronic valve and the second electronic valve may be calculated as 0.36875 (36.875%) and 0.0975 (9.75%), respectively.

However, if the hot water temperature measured by the first temperature sensor is less than the discharged water temperature, in step 530, the faucet control device 100 controls the heating member 110 to be operated until the hot water temperature measured by the third temperature sensor becomes the target temperature of the discharged water corresponding to the horizontal rotation angle of the faucet knob, controls the first electronic valve 130*a* to be fully opened, and controls the second electronic valve 130*b* to be closed.

The above embodiment has a configuration of calculating a target temperature of the discharged water and a target quantity of the discharged water based on the vertical and horizontal rotation amounts of the faucet knob. In contrast, the faucet control device 100 according to the present invention may receive information corresponding to the vertical and horizontal rotation amounts of the faucet knob instead of the faucet knob from a user through a separate input device. Further, instead of the information corresponding to the vertical and horizontal rotation amounts of the faucet knob, a temperature and a quantity of the discharged water to be desired by the user may be received from the user. In this case, the separate input device may be a smart phone, a control panel including an input device and an output device, or the like. When the smart phone is used as an input device, it is preferable that an application for controlling the faucet control device 100 according to the present invention is installed on the smart phone. On the output device of the control panel, a cold water temperature, a hot water temperature, a cold water quantity, a hot water quantity, a discharged water temperature, a discharged water quantity, etc. are selectively displayed according to a user's selection or a setting status. In addition, the input device of the control panel may have a form such as a touch screen, a voice recognition device, and a button input device. In this case, the faucet control device 100 according to the present invention includes a communication unit for transmitting and receiving data with the input device and the output device, and a device capable of wired or wireless communication including a Bluetooth module and a Wi-Fi module may be adopted as the communication unit.

In step 535, the faucet control device 100 determines whether the hot water temperature measured by the first temperature sensor 120*a* reaches the target temperature of the discharged water after the heating member 110 is operated.

When the hot water temperature reaches the target temperature of the discharged water, in step 540, the faucet control device 100 controls the operation of the heating member 110 to be stopped. Then, the process proceeds to step 510.

Figure 6:
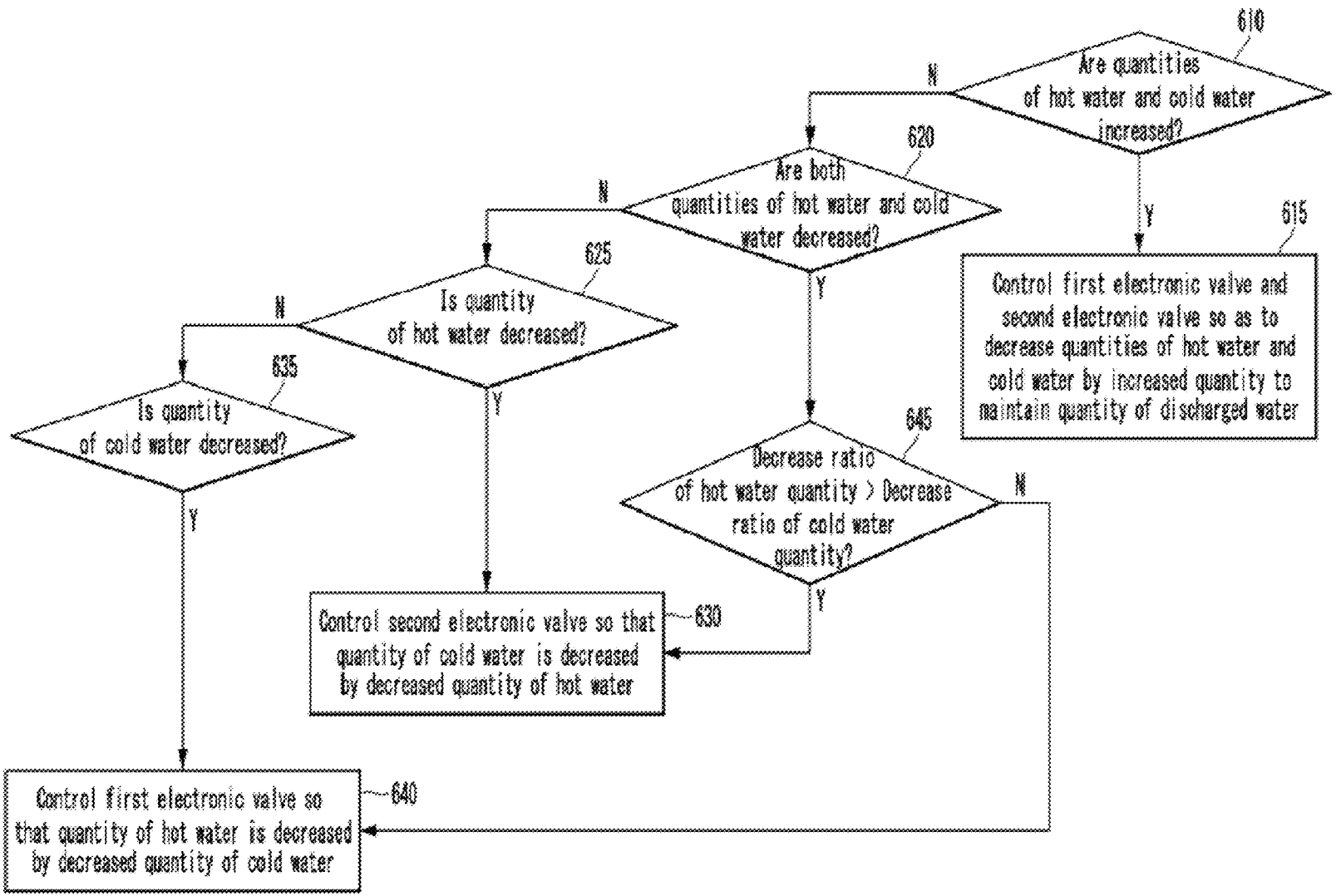
FIG. 6 is a flowchart illustrating a method for controlling a first electronic valve and a second electronic valve according to changes in quantities of hot water and cold water according to an embodiment of the present invention.

FIG. 6 is a flowchart illustrating a method for controlling a first electronic valve and a second electronic valve according to changes in quantities of hot water and cold water according to an embodiment of the present invention. Hereinafter, a method of controlling the opening degrees of the first electronic valve 130*a* and the second electronic valve 130*b* according to the changes in quantities of the hot water and the cold water after the faucet control device 100 monitors the changes in quantities of the hot water and the cold water will be described.

In step 610, the faucet control device 100 determines whether the quantities of the hot water and the cold water have increased.

If the quantities of the hot water and the cold water increase, in step 615, the faucet control device 100 controls the first electronic valve and the second electronic valve to decrease the quantities of the hot water and the cold water by the increased quantity to maintain the quantity of the discharged water.

For example, assuming that the quantities of the hot water and the cold water have increased by 20% and 10% compared to the quantities in a normal state, respectively, the faucet control device 100 may control the opening degrees of the first electronic valve 130*a* and the second electronic valve 130*b* to be adjusted so as to decrease the quantities of the hot water and the cold water to be decreased by 20% and 10%, which are increased amounts.

However, when the quantities of the hot water and the cold water have not increased, in step 620, the faucet control device 100 determines whether both the quantities of the hot water and the cold water have decreased.

When the quantities of the hot water and the cold water have not decreased, in step 625, the faucet control device 100 determines whether the quantity of the hot water has decreased.

If the quantity of the hot water decreases, in step 630, the faucet control device 100 may control the opening degree of the second electronic valve 130*b* so as to decrease the quantity of the cold water by the decreased quantity of the hot water. The faucet control device 100 may calculate the opening degree of the second electronic valve 130*b* to maintain the temperature of the discharged water by decreasing the quantity of the discharged water discharged from the faucet 3. That is, when the quantity of the hot water decreases by 10% compared to the quantity in the normal state, the opening degree of the second electronic valve 130*b* may be calculated to decrease the quantity of the cold water by 10%.

For another example, the faucet control device 100 increases the quantity of the cold water by the decreased quantity of the hot water and control the heating member 110 to be operated in order to maintain the quantity of the discharged water discharged from the faucet 3 and maintain the temperature of the discharged water.

In this case, the faucet control device 100 may calculate a hot water heating temperature of the heating member 110 according to the decreased amount of the hot water using Equation 10. Here, the hot water heating temperature may be a temperature measured by the third temperature sensor that measures the temperature of the hot water located inside the heating member 110 or passing through the heating member 110.

$$T'_H = \frac{T_{T\theta_H} Q_T - T_L(Q_L + \Delta Q)}{(Q_H - \Delta Q)} \quad \text{[Equation 9]}$$

Wherein, $T'_H$ represents a heating temperature of the hot water by the heating member 110, $\Delta_Q$ represents a decreased quantity of the hot water, $Q_T$ represents a quantity of the discharged water when the horizontal rotation angle is $\theta_H°$, $T_{T\Theta H}$ represents a temperature of the discharged water in the normal state when the horizontal rotation angle is $\theta_H°$, $Q_H$ represents a quantity of the hot water in the normal state, $Q_L$ represents a quantity of the cold water in the normal state, and $T_L$ represents a temperature of the cold water.

Thereafter, when the quantity of the hot water increases, the faucet control device 100 may control the second electronic valve 130*b* to decrease the cold water quantity while lowering the temperature of the heating member 110 by Equation 10 until reaching the normal state.

As the determining result in step 625, when the quantity of the hot water is not decreased, in step 635, the faucet control device 100 determines whether the quantity of the cold water has decreased.

If the quantity of the cold water decreases, in step 640, the faucet control device 100 may control the opening degree of the first electronic valve 130*a* so as to decrease the quantity of the hot water by the decreased quantity of the cold water.

When the cold water quantity decreases, the problem cannot be solved by operating the heating member 110, and thus, the faucet control device 100 may control the opening degree of the first electronic valve 130*a* to decrease the quantity of the discharged water and maintain the temperature of the discharged water.

For example, when the quantity of the cold water decreases by 10% compared to the quantity in a normal state, the faucet control device 100 may control the opening degree of the first electronic valve 130*a* so that the quantity of the hot water also decreases by 10%.

Returning back to step 620, as the determining result in step 620, if the quantities of the hot water and the cold water have decreased, in step 645, the faucet control device 100 determines whether a decrease ratio of the hot water quantity is greater than a decrease ratio of the cold water quantity.

If the decrease ratio of the hot water quantity is greater than the decrease ratio of the cold water quantity, the process proceeds to step 630. However, when the decrease ratio of the hot water quantity is smaller than the decrease ratio of the cold water quantity, the process proceeds to step 640.

Although not illustrated separately in FIG. 6, the process proceeds to step 610 after step 615, step 630, and step 640, and changes in quantities of the hot water and the cold water are continuously monitored and the opening degrees of the first electronic valve 130*a* and the second electronic valve 130*b* may be controlled.

Since the method itself of deriving the opening degrees of the first electronic valve 130*a* and the second electronic valve 130*b* according to the quantity of the hot water and the quantity of the cold water is the same as already described in FIG. 2, even if there is no detailed description thereof, it should be understood that the opening degrees of the first electronic valve 130*a* and the second electronic valve 130*b* according to the changes in quantity of the hot water and quantity of the cold water are calculated in the same manner as described in FIG. 2.

On the other hand, when the valves are controlled according to changes in quantities of the hot water and the cold water, changes in pressures of the hot water and the cold water, etc. as described above, there may be a problem in that the opening degrees of the valves need to be adjusted too often when responding immediately to each change. To prevent the problem, after the temperature of the discharged water reaches the normal state according to the rotation amount of the faucet knob, even if the temperatures of the hot water and the cold water are changed or the quantities thereof are changed, it is preferable to control the valves only when the temperature of the discharged water is greater than a reference change amount (e.g., ±3° C.) defined in advance as compared to the temperature of the discharged water in the normal state or changes in quantities of the hot water and the cold water are greater than a reference change amount (e.g., change in quantity of ±10%) defined in advance. When the valves are controlled as described above, in the above-described embodiment, a difference is smaller than between 31.46° C. which is the temperature of the discharged water when the horizontal rotation angle and the vertical rotation angle of the faucet knob are 30° and 20°, respectively, and 34.32° C. which is the temperature of the discharged water in the normal state for the rotation angle of the corresponding faucet knob, and thus the valves are maintained as they are. Furthermore, since the changes in pressures of the hot water and the cold water consequently affect the temperature of the discharged water, when the pressures of the hot water and the cold water are changed, a change amount in temperature according to the change amount in pressure may be calculated to determine whether to control the valves.

On the other hand, when the degrees of changes in pressures of the hot water and the cold water are large, there may be a problem that the quantity of the discharged water is excessively decreased. Therefore, a control is required to maintain the quantity of the discharged water to a target quantity corresponding to the horizontal rotation angle and the vertical rotation angle of the faucet knob. A situation where the maximum supply quantities of the hot water and the cold water are 0.0002 $m^3/s$ and 0.0003 $m^3/s$, respectively, and the maximum supply temperatures of the hot water and the cold water are 45° C. and 20° C., respectively, will be described as an example. In this situation, if the current quantities of the hot water and the cold water are supplied as much as the maximum supply quantities, the temperatures of the hot water and the cold water are also supplied by the maximum supply temperatures, and both the horizontal rotation angle and the vertical rotation angle of the faucet knob are set to 45°, the quantity of the discharged water is 0.00025 $m^3/s$, and the temperature of the discharged water is 30° C.

In such a state, when water is used in another place, the quantities of the hot water and the cold water are decreased. At this time, if both the hot water and the cold water are decreased by more than half (that is, when the quantities of the hot water and the cold water are supplied at less than 0.0001 $m^3/s$ and 0.00015 $m^3/s$, respectively), the quantity of the discharged water is less than the target quantity of 0.00025 $m^3/s$. In this case, the opening degrees of the first electronic valve 130*a* and the second electronic valve 130*b* are controlled to be as close to the target quantity of the discharged water as possible, but since the decrease ratio of the hot water is greater than the decrease ratio of the cold water, when the temperature does not reach the target temperature of the discharged water, the opening degrees are controlled to meet the target temperature of the discharged water by driving the heater.

Unlike this, when the sum of the quantities of the hot water and the cold water is greater than or equal to the target quantity of the discharged water, the control is performed as follows.

When the decreased quantity of the hot water is greater than that of the cold water (e.g., the supply quantity of the hot water is 0.00006 $m^3/s$ and the supply quantity of the cold water is 0.0002 $m^3/s$), the target quantity of the discharged water may be supplied. In this case, the opening degrees of the first electronic valve 130*a* and the second electronic valve 130*b* are controlled so that the quantities of the hot water and the cold water are 0.00006 $m^3/s$ and 0.00019 $m^3/s$, respectively, and the heater is driven to heat the hot water to 61.67° C., and thus, the temperature of the discharged water is controlled to be the target temperature of 30° C. Unlike this, when the decreased quantity of the hot water is smaller than that of the cold water (e.g., the supply quantity of the hot water is 0.00016 $m^3/s$ and the supply quantity of the cold water is 0.0001 $m^3/s$), the target quantity of the discharged water may be supplied. However, if the opening degrees of the first electronic valve 130*a* and the second electronic valve 130*b* are controlled so that the quantities of the hot water and the cold water become 0.00015 $m^3/s$ and 0.0001 $m^3/s$, respectively, in order to meet the target quantity of the discharged water, the temperature of the discharged water becomes 36.8° C., exceeding the target temperature of 30° C. Therefore, in this case, it is preferable to control the opening degrees of the first electronic valve 130*a* and the second electronic valve 130*b* so that the hot water and the cold water are 0.000067 $m^3/s$ and 0.0001 $m^3/s$, respectively, and when controlling the opening degrees as such, the temperature of the discharged water is 30° C. and the quantity thereof is 0.000167 $m^3/s$.

On the other hand, the faucet control device according to the present invention may set the target temperature of the discharged water differently for each season or for each user. For example, the same user may feel the discharged water of 30° C. so hot in summer, while so cold in winter. Therefore, it is preferable to adaptively set the target temperature of the discharged water according to the season for user-friendly control. For example, the target temperature of the discharged water for the horizontal rotation amount of the faucet knob may be decreased by 10% in summer and increased by 10% in winter. Of course, this control may be performed based on an outdoor temperature or a temperature of a place where the faucet is located, without being performed just for the season. For example, when the temperature at the place where the faucet is located is lower than a specific set temperature (e.g., 30° C.), the target temperature of the discharged water for the horizontal rotation amount of the faucet knob is increased by 10%, and when the temperature is greater than or equal to the set temperature, the target temperature of the discharged water may be increased by 10%. Such a control may be applied equally even to a case of receiving rotation information of the faucet knob from the user through a separate input device or directly receiving the target temperature and quantity of the discharged water. Furthermore, when receiving the rotation information of the faucet knob from the user through the separate input device or directly receiving the target temperature and quantity of the discharged water, the target temperature of the discharged water may be set differently for each user. That is, by establishing and analyzing the preferred temperature and quantity of the discharged water for each user, it is possible to control the target temperature and the target quantity of the discharged water with respect to the rotation amount of the same faucet knob differently for each user. In this case, when the input device is a smart phone, information about the user may be easily determined by automatically receiving the information about the user from the smart phone. In contrast, when a control panel is used as the input device, the user may be set through the control panel.

As described above, the present invention has been described with reference to the embodiments, but it will be understood to those skilled in the art that various modifications and changes of the present invention can be made without departing from the spirit and the scope of the present invention which are disclosed in the following claims.

The invention claimed is:

1. A faucet control device comprising:

a first pressure sensor and a second pressure sensor installed in a hot water pipe and a cold water pipe to measure the pressures of hot water and cold water, respectively;

a first temperature sensor and a second temperature sensor installed in the hot water pipe and the cold water pipe to measure the temperatures of the hot water and the cold water, respectively;

a first electronic valve and a second electronic valve installed on discharge ports of the hot water and the cold water, respectively;

a heating member disposed between the hot water pipe and the first electronic valve;

a third temperature sensor disposed on a hot water discharge port of the heating member or inside the heating member and measuring the temperature of the hot water discharged from the heating member;

a rotation sensor for measuring at least one of a horizontal rotation angle and a vertical rotation angle when an operation of a faucet knob terminates; and a controller for determining a stop position of the faucet knob by using at least one of the horizontal rotation angle and the vertical rotation angle, and controlling whether to operate the heating member and the opening degrees of the first electronic valve and the second electronic valve according to the determined stop position of the faucet knob by using the pressures of the hot water and the cold water and the temperatures of the hot water and the cold water, wherein the controller calculates a target quantity and a target temperature of the discharged water corresponding to the stop position of the faucet knob and monitors the quantity of the hot water and the quantity of the cold water by using the pressure of the hot water and the pressure of the cold water to adaptively control the opening degrees of the first electronic valve and the second electronic valve, wherein (a) when the temperature of the hot water measured by the first temperature sensor is less than the target temperature of the discharged water, (a1) the controller operates the heating member until the temperature of the hot water measured by the third temperature sensor reaches the target temperature of the discharged water corresponding to the stop position of the faucet knob and controls the second electronic valve to be closed, and when the quantity of the hot water calculated by using the pressure of the hot water is less than the target quantity of the discharged water corresponding to the stop position of the faucet knob, the controller controls the first electronic valve to be fully opened, and when the quantity of the hot water calculated by using the pressure of the hot water is greater than the target quantity of the discharged water corresponding to the stop position of the faucet knob, the controller controls the opening degree of the first electronic valve so that the quantity of the discharged water is the same as the target quantity of the discharged water corresponding to the stop position of the faucet knob, and (a2) when the temperature of the hot water measured by the first temperature sensor reaches the target temperature of the discharged water corresponding to the stop position of the faucet knob, the controller stops the operation of the heating member and controls the opening degrees of the first electronic valve and the second electronic valve based on the quantities of the hot water and the cold water calculated by using the pressures of the hot water and the cold water and the temperatures of the hot water and the cold water measured by the first temperature sensor and the second temperature sensor, so that the quantity and the temperature of the discharged water become the target quantity and the target temperature, (b) when the temperature of the hot water measured by the first temperature sensor is greater than or equal to the target temperature of the discharged water, (b1) the controller controls the opening degrees of the first electronic valve and the second electronic valve based on the quantities of the hot water and the cold water calculated by using the pressures of the hot water and the cold water and the temperatures of the hot water and the cold water, so that the quantity and the temperature of the discharged water become the target quantity and the target temperature, and (b2) when at least one of the pressure of the hot water measured by the first pressure sensor and the pressure of the cold water measured by the second pressure sensor is changed while the quantity and the temperature of the discharged water become the target quantity and the target temperature, (b21) when both the pressure of the hot water and the pressure of the cold water are increased, the controller controls the opening degrees of the first electronic valve and the second electronic valve so that the quantity and the temperature of the discharged water become the target quantity and the target temperature of the discharged water by decreasing the quantity of the hot water and the quantity of the cold water, (b22) when the pressure of the hot water is decreased, the controller controls the opening degree of the second electronic valve so as to increase the quantity of the cold water by the decreased quantity of the hot water and operates the heating member to control the temperature of the hot water to be increased, and (b23) when the quantity of the cold water is decreased, the controller controls the opening degree of the first electronic valve so as to decrease the quantity of the hot water by the decreased quantity of the cold water.

2. The faucet control device of claim 1, wherein the controller sets the middle of a maximum horizontal rotation angle of the faucet knob as a horizontal rotation reference point, sets the lowest position of the faucet knob as a vertical rotation reference point, and calculates the horizontal rotation angle and the vertical rotation angle of the faucet knob by using the horizontal rotation reference point and the vertical rotation reference point.

3. The faucet control device of claim 1, wherein the heating member is configured by a plurality of heaters, which are sequentially operated from a heater installed adjacent to an inflow point of the hot water pipe.

4. The faucet control device of claim 1, wherein (b24) (b21) to (b23) are performed when a temperature change amount of the discharged water according to changes in pressures of the hot water and the cold water is greater than a reference change amount set in advance.

5. A faucet comprising:

a hot water pipe;

a cold water pipe;

a faucet knob;

a first temperature sensor and a second temperature sensor installed at a hot water inlet of the hot water pipe and a cold water inlet of the cold water pipe, respectively;

a first pressure sensor and a second pressure sensor installed in the hot water pipe and the cold water pipe, respectively;

a first electronic valve and a second electronic valve installed on a hot water discharge port of the hot water pipe and a cold water discharge port of the cold water pipe, respectively;

a heating member installed between the hot water inlet of the hot water pipe and the first electronic valve;

a third temperature sensor installed on the hot water outlet of the heating member or inside the heating member;

a rotation sensor for measuring at least one of a horizontal rotation angle and a vertical rotation angle when an operation of the faucet knob terminates; and a controller for determining a stop position of the faucet knob by using at least one of the horizontal rotation angle and the vertical rotation angle, and controlling whether to operate the heating member, the opening degree of the first electronic valve, and the opening degree of the second electronic valve based on the values measured by the first temperature sensor, the second temperature sensor, the third temperature sensor, the first pressure sensor, and the second pressure sensor, wherein the controller calculates a target quantity and a target temperature of the discharged water corresponding to the stop position of the faucet knob and monitors the pressure of the hot water and the pressure of the cold water and the temperature of the hot water and the temperature of the cold water to adaptively control whether to operate the heater, the opening degree of the first electronic valve, and the opening degree of the second electronic valve, wherein (a) when the temperature of the hot water measured by the first temperature sensor is less than the target temperature of the discharged water, (a1) the controller operates the heating member until the temperature of the hot water measured by the third temperature sensor reaches the target temperature of the discharged water corresponding to the stop position of the faucet knob and controls the second electronic valve to be closed, and when the quantity of the hot water calculated by using the pressure of the hot water is less than the target quantity of the discharged water corresponding to the stop position of the faucet knob, the controller controls the first electronic valve to be fully opened, and when the quantity of the hot water calculated by using the pressure of the hot water is greater than the target quantity of the discharged water corresponding to the stop position of the faucet knob, the controller controls the opening degree of the first electronic valve so that the quantity of the discharged water is the same as the target quantity of the discharged water corresponding to the stop position of the faucet knob, and (a2) when the temperature of the hot water measured by the first temperature sensor reaches the target temperature of the discharged water corresponding to the stop position of the faucet knob, the controller stops the operation of the heating member and controls the opening degrees of the first electronic valve and the second electronic valve based on the quantities of the hot water and the cold water calculated by using the pressures of the hot water and the cold water and the temperatures of the hot water and the cold water measured by the first temperature sensor and the second temperature sensor, so that the quantity and the temperature of the discharged water become the target quantity and the target temperature, (b) when the temperature of the hot water measured by the first temperature sensor is greater than or equal to the target temperature of the discharged water, (b1) the controller controls the opening degrees of the first electronic valve and the second electronic valve based on the quantities of the hot water and the cold water calculated by using the pressures of the hot water and the cold water and the temperatures of the hot water and the cold water, so that the quantity and the temperature of the discharged water become the target quantity and the target temperature, and (b2) when at least one of the pressure of the hot water measured by the first pressure sensor and the pressure of the cold water measured by the second pressure sensor is changed while the quantity and the temperature of the discharged water become the target quantity and the target temperature, (b21) when both the pressure of the hot water and the pressure of the cold water are increased, the controller controls the opening degrees of the first electronic valve and the second electronic valve so that the quantity and the temperature of the discharged water become the target quantity and the target temperature of the discharged water by decreasing the quantity of the hot water and the quantity of the cold water, (b22) when the pressure of the hot water is decreased, the controller controls the opening degree of the second electronic valve so that the temperature of the discharged water becomes the target temperature of the discharged water by decreasing the quantity of the cold water by the decreased quantity of the hot water, or controls the opening degree of the second electronic valve so as to increase the quantity of the cold water by the decreased quantity of the hot water and operates the heating member to control the temperature of the hot water to be increased, and (b23) when the quantity of the cold water is decreased, the controller controls the opening degree of the first electronic valve so as to decrease the quantity of the hot water by the decreased quantity of the cold water.

6. The faucet of claim 5, wherein the heating member is configured by a plurality of heaters, which are sequentially operated from a heater installed adjacent to an inflow point of the hot water pipe.

7. The faucet of claim 5, wherein (b24) (b21) to (b23) are performed when a temperature change amount of the discharged water according to changes in pressures of the hot water and the cold water is greater than a reference change amount set in advance.

* * * * *